US008128312B2

(12) United States Patent
Stuchell

(10) Patent No.: US 8,128,312 B2
(45) Date of Patent: Mar. 6, 2012

(54) SUPPORT MEMBERS AND METHODS FOR THE INSTALLATION OF BRICK PATIOS, DECKS AND PATHS

(75) Inventor: Bart Stuchell, Alliance, OH (US)

(73) Assignee: Bart Stuchell, Alliance, OH (US)

( * ) Notice: Subject to any disclaimer, the term of this patent is extended or adjusted under 35 U.S.C. 154(b) by 672 days.

(21) Appl. No.: 12/016,154

(22) Filed: Jan. 17, 2008

(65) Prior Publication Data

US 2008/0168732 A1 Jul. 17, 2008

Related U.S. Application Data

(60) Provisional application No. 60/880,735, filed on Jan. 17, 2007.

(51) Int. Cl.
*E01C 3/00* (2006.01)

(52) U.S. Cl. ..... 404/43

(58) Field of Classification Search ..... 404/8, 34, 404/43, 45; 14/73

See application file for complete search history.

(56) References Cited

U.S. PATENT DOCUMENTS

| | | | | | |
|---|---|---|---|---|---|
| 113,787 | A * | 4/1871 | New | 404/43 |
| 2,120,802 | A * | 6/1938 | Focht | 52/479 |
| 3,916,563 | A * | 11/1975 | Tedesh | 47/33 |
| 3,969,851 | A | 7/1976 | Whitacre | |
| 4,474,504 | A * | 10/1984 | Whitman et al. | 405/16 |
| 5,363,614 | A | 11/1994 | Faulkner | |
| 5,511,353 | A * | 4/1996 | Jones | 52/536 |
| 5,568,994 | A | 10/1996 | Dawson | |
| 5,993,107 | A * | 11/1999 | Bauer | 404/43 |
| 6,036,402 | A | 3/2000 | Meldrum et al. | |
| 6,171,015 | B1 * | 1/2001 | Barth et al. | 404/34 |
| 6,520,471 | B2 | 2/2003 | Jones et al. | |
| 6,695,527 | B2 * | 2/2004 | Seaux et al. | 404/34 |
| 6,851,236 | B1 * | 2/2005 | Harvey | 52/403.1 |
| 7,270,497 | B2 * | 9/2007 | Von Langsdorff | 404/39 |
| 7,344,334 | B2 * | 3/2008 | Thorkelson | 404/29 |
| 7,914,228 | B2 * | 3/2011 | Rapaz | 404/34 |
| 2005/0284082 | A1 | 12/2005 | Smith | |
| 2007/0193163 | A1 | 8/2007 | Busby et al. | |
| 2008/0168732 | A1 | 7/2008 | Stuchell | |

OTHER PUBLICATIONS

Sare Plastics , injection molding, plastic injection molding, custom molding, plastic parts website pages; 2007.

GratedeX by deXstone Stone Decking and Patio System webpages, 2005.

* cited by examiner

*Primary Examiner* — Gary S Hartmann

(74) *Attorney, Agent, or Firm* — Daniel J. Schlue; Roetzel & Andress

(57) ABSTRACT

The present invention relates generally to structures and methods for constructing a paved structure. Some embodiments relate to improved, simplified and/or lightweight means for the construction of such structures. Some embodiments relate to means for constructing a paved area having a shelf for vertically supporting bricks. Furthermore, in some embodiments the shelf can be in a raised relation to a substrate. Some embodiments may also include structures that facilitate drainage of liquids from a surface of the paved structure.

12 Claims, 3 Drawing Sheets

SUPPORT MEMBERS AND METHODS FOR THE INSTALLATION OF BRICK PATIOS, DECKS AND PATHS

RELATED APPLICATIONS

The present application claims priority to U.S. Provisional Patent Application No. 60/880,735 filed Jan. 17, 2007, which is hereby incorporated by reference in its entirety.

BACKGROUND OF THE INVENTION

I. Field of the Invention

The present invention relates generally to structures and methods for constructing a paved structure. Some embodiments relate to improved, simplified and/or lightweight means for the construction of such structures.

II. Description of the Related Art

The value of a home can be enhanced with a brick patio, deck, or path. Because brick pavers are beautiful, enduring and essentially maintenance free, it is not surprising that many homeowners want such additions. Often homeowners take the project on themselves. Installation can be simple; however, cracked slabs will result from ground shifts if the installation is done improperly. The current and the popular method for installing a brick patio, deck or path comprises the steps of compacting the sub-soil, adding and compacting a gravel layer, spreading a sand or a stone screening, leveling the screening, laying the brick, filling the cracks with screening, compacting the brick to a level surface and sweeping the screening into the open cracks.

Some problems with current designs include complex assembly methods that require a skilled craftsman. Additionally, current designs are generally very heavy and are therefore not suitable for use on structures that have low weight limits, such as many common balcony designs. Thus, there is a need in the art for an improved method of installation, and for lighter weight structures. Some embodiments of the present invention may provide improved structures and related methods for installing brick pavers.

SUMMARY OF THE INTENTION

Some embodiments relate to a brick paver shelf, comprising: a plurality of internal support walls arranged to form a regular two-dimensional network pattern of walls, internal vertices, and peripheral vertices, and the pattern having a top face and a bottom face spaced apart from the top face and defining a thickness sufficient to support a plurality of brick pavers; at least one external support wall connected to the perimeter of the regular two-dimensional pattern at one or more peripheral vertices of the pattern, the at least one external support wall being adapted to seat upon a support structure in a horizontal orientation, wherein the top face is directed in an upward direction; and a first locking component disposed in the at least one external support wall, wherein the locking component is mateable with a second locking component.

Some embodiments relate to a brick paver support structure, comprising: at least a first and second lateral support member each having a first face and a second face spaced apart from the first face and defining a thickness, the first and second faces being approximately parallel and defining an elongate rectangular shape, the lateral support members each having a ledge on at least one of the first and second faces, and the at least two lateral support members being spaced apart and oriented in a parallel relation so that their ledges face each other and form a seat adapted to receive a shelf member in a vertically supportive relation; a shelf member adapted to be received by, and seat upon, the ledges of the first and second lateral supports in a raised relation relative to a substrate and defining a space bounded by the lateral supports, the shelf and the substrate, and wherein the shelf member further comprises a plurality of perforations providing fluid communication between the top of the shelf to the space under the shelf.

Some embodiments also relate to a paved structure, comprising: the brick paver support structure as set forth in the preceding paragraph, a plurality of paver bricks disposed on the shelf member; and a filler material disposed between the paver bricks.

BRIEF DESCRIPTION OF THE DRAWINGS

Embodiments of the present invention will become better understood with reference to the following detailed description and claims taken in conjunction with the accompanying drawings, in which like elements correspond to like symbols, and in which:

DETAILED DESCRIPTION

Figure 1:
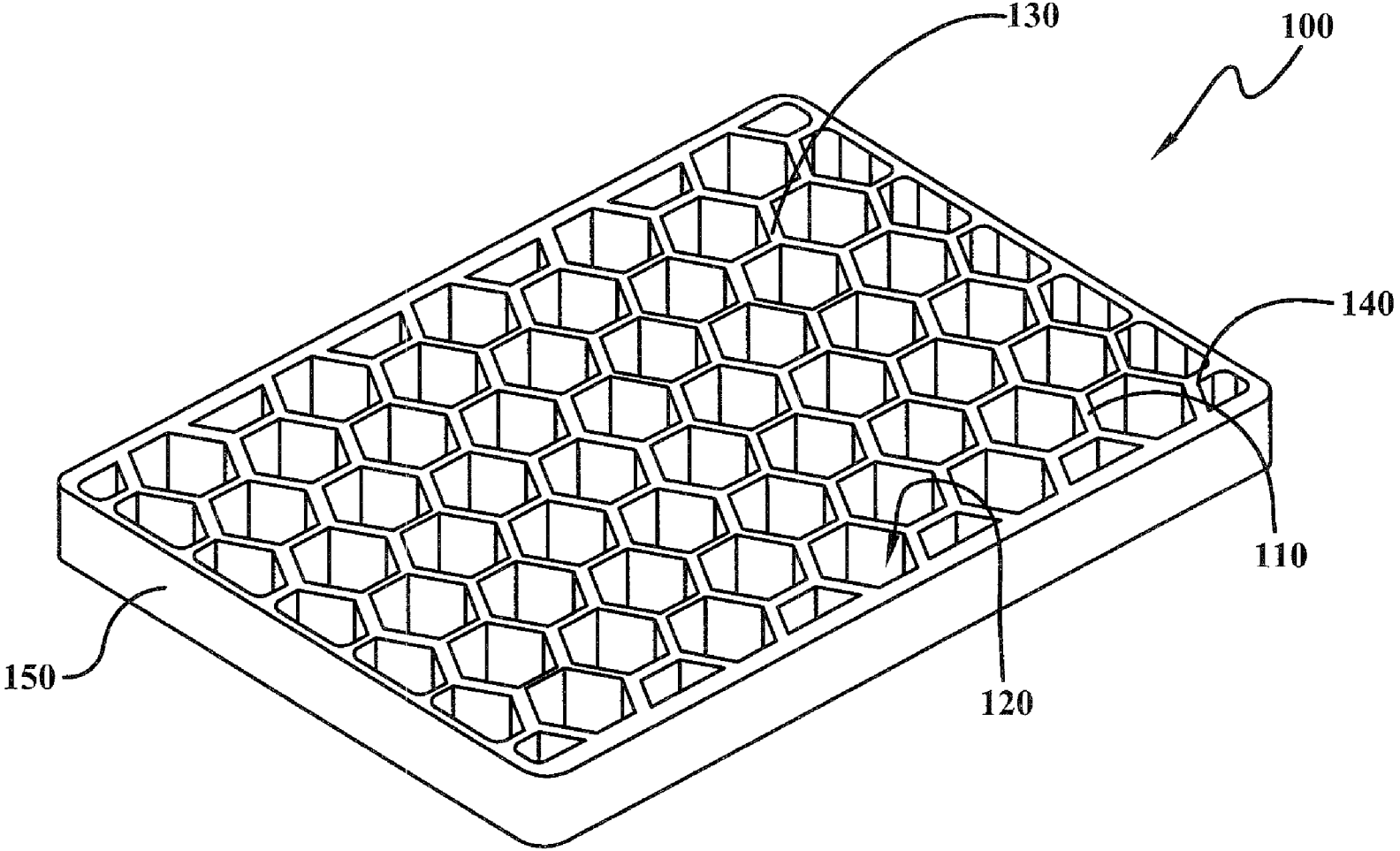
FIG. 1 is a perspective view of a support member according to an embodiment of the present invention.

Some embodiments relate to support structures for paver-type bricks (hereinafter "brick pavers"). According to some embodiments, support structures are adapted to provide for proper drainage and to support a compression and/or shear load.

The term "regular," as used herein in the context of two-dimensional patterns, includes patterns that are symmetric and capable of repeating indefinitely without breaking the pattern.

In some embodiments a brick paver support structure comprises one or more brick paver shelves, and one or more seats for supporting the shelves. In some embodiments a seat is comprised of a pair of lateral supports adapted to support the edges of one or more shelves. Some embodiments also include a medial support for supporting the edges of adjacent pairs of shelves.

In some embodiments, a brick paver shelf comprises a plurality of support walls arranged according to a regular two-dimensional geometric pattern, the two-dimensional pattern having a thickness defining a top face and a bottom face. For example, according to one embodiment, support walls can be connected and form vertices. Furthermore, according to such embodiments, the walls can form an extended network of vertices. In some embodiments such a network of walls and vertices can comprise any of a variety of two-dimensional geometric shapes including, but not limited to, circles, triangles, rectangles, pentagons, hexagons, heptagons, octagons, higher polygons and the like, or any appropriate combination thereof. According to some embodiments, appropriate combinations of geometric shapes include combinations that are capable of extending indefinitely over a two-dimensional space without breaking the pattern. For example, octagons can be combined with rectangles to form a regular repeating pattern.

Embodiments comprising support walls that are arranged in a regular repeating pattern include at least two types of vertices. A first type connects a maximum number of support walls and is referred to herein as an internal vertex. A second type connects less than a maximum number of support walls and is located at an edge of the two-dimensionally extending pattern of support walls. This type of vertex is referred to herein as a peripheral vertex. In some embodiments peripheral vertices can connect the pattern of support walls to one or more other structures.

Furthermore, embodiments comprising support walls that are arranged in a regular repeating pattern also define openings. The openings are defined by the empty space between walls, and the openings permit the top face of the two-dimensional support structure to be in fluid communication with the bottom face. According to such embodiments, a fluid disposed in a space on one side of a brick paver shelf can pass through an opening and enter the space on the other side of the brick paver shelf.

In some embodiments the two-dimensional network of support walls and vertices can be connected at one or more peripheral vertices to a surrounding support structure referred to herein as an external support wall. In such embodiments, the support walls comprising the two-dimensional pattern are referred to as internal support walls. Thus, the components of such embodiments include internal support walls, vertices, and one or more external support walls.

In one embodiment an external support wall comprises a rectangular perimeter and the space within the perimeter is filled with a regular repeating pattern of internal support walls, which are connected to the external support wall at one or more peripheral vertices. In other embodiments, an external support wall can comprise shapes including, but not limited to, circles, triangles, squares, pentagons, hexagons, heptagons, octagons, higher polygons and the like, or any combination thereof.

Brick paver shelves consistent with the present invention can comprise any of a wide variety of dimensions. In one embodiment, a paver shelf comprises a rectangular shelf that is about 18 to 24 inches in length, about 14.5 to 15.5 inches in width, and about 2 inches in height. In some embodiments, sides can range in length from about 10 inches to about 100 inches. More specifically, in some embodiments sides can range in length from about 10 to about 20 inches, about 20 to about 30 inches, about 30 to about 40 inches, about 40 to about 50 inches, about 50 to about 60 inches, about 60 to about 70 inches, about 70 to about 80 inches, about 80 to about 90, or even about 90 to about 100 inches. Here as elsewhere in the specification and claims ranges may be combined. Furthermore, according to some embodiments, brick paver shelves can define a thickness from about 0.25 to about 10 inches. In some embodiments the thickness can be from about 0.25 to about 2 inches, about 2 to 4 inches, about 4 to 6 inches, about 6 to 8 inches, or even about 8 to 10 inches.

Brick paver shelves of the present invention can also comprise any of a variety of materials including organic polymers. For example, a non-limiting list of organic polymers within the scope of the present invention includes polyolefins such as polypropylene, polyethylene, derivatives thereof, and/or any combination thereof. Other polymers include vinyl polymers, phenolic polymers, polycarbonates, polystyrene, polyesters, polyethylene teraphthalates, nylons, and the like, any derivatives thereof, any copolymers thereof, and/or any combination thereof. In embodiments comprising one or more organic polymers, the polymer material can comprise one or more appropriate additives such as binders, plasticizers, fillers and the like. Some binders can include epoxides, polyolefins, and any of a wide variety of binders known to one of ordinary skill in the art. Some fillers can include fiberglass, talc and other common fillers as would be apparent to one of ordinary skill in the art. One of ordinary skill in the art will be readily able to select appropriate polymeric materials, fillers, binders, and/or plasticizers based upon properties such as tensile strength, moldability, melting point, glass transition temperatures, cost and the like.

In some embodiments an external support wall can include a locking mechanism that is adapted to mechanically join adjacent brick paver shelves. In one embodiment, the locking mechanism includes a female locking component and a male locking component adapted to mate with the female component. In some embodiments the female locking component can be disposed in the external support wall of a shelf or on another body. Similarly, a male locking component can be disposed in the external support wall of an opposing shelf or on another body. For example, in one embodiment the external support wall of a first shelf includes one or more male locking components. In such embodiments, an adjacent shelf includes one or more female locking components that are adapted to mate with the male components of the first shelf. Furthermore, in some embodiments a single shelf can have both male and female components that are arranged so as to mate with adjacent shelves.

In still other embodiments, the shelves can only have female locking components. In such embodiments a second part having two male ends would be required to join the shelves. For instance, according to such embodiments, a pair of shelves having only female locking components can be arranged so that the female components are in an adjacent relation. A doubled ended male locking component can then be inserted into both female components thereby locking the two shelves together. Conversely, other embodiments can have shelves that include only male locking components, and a doubled ended female locking component can be used to join the shelves.

One of skill in the art will recognize that a wide variety of geometries can be appropriate for the male and female locking components. For instance, a double ended male component could comprise a dumbbell shape having a rounded, rectangular, semi-circular, or oblong end. According to such embodiments, the ends may be either symmetric or asymmetric.

Furthermore, in embodiments where a male or female locking component is a separate part from the paver brick shelf, such locking component can be formed from any of a wide variety of materials, such as organic polymers. For example, a non-limiting list of organic polymers within the scope of the present invention includes polyolefins such as polypropylene, polyethylene, derivatives thereof, and/or any combination thereof. Other polymers include vinyl polymers, phenolic polymers, polycarbonates, polystyrene, polyesters, polyethylene teraphthalates, nylons, and the like, any derivatives thereof, any copolymers thereof, and/or any combination thereof. In embodiments comprising one or more organic polymers, the polymer material can comprise one or more appropriate additives such as binders, plasticizers, fillers and the like. Some binders can include epoxides, polyolefins, and any of a wide variety of binders known to one of ordinary skill in the art. Some fillers can include fiberglass, talc and other common fillers as would be apparent to one of ordinary skill in the art. One of ordinary skill in the art will be readily able to select appropriate polymeric materials, fillers, binders, and/or plasticizers based upon properties such as tensile strength, moldability, melting point, glass transition temperatures, cost, and the like.

Embodiments having brick elements can comprise bricks that include any of a wide variety of organic and/or inorganic materials. For example, some bricks can be of a traditional nature, such as clay fired bricks or concrete bricks. In other embodiments, a brick can comprise an organic polymer material. For example, a non-limiting list of organic polymers within the scope of the present invention includes polyolefins such as polypropylene, polyethylene, derivatives thereof, and/or any combination thereof. Other polymers include vinyl polymers, phenolic polymers, polycarbonates, polystyrene, polyesters, polyethylene teraphthalates, nylons, and the like, any derivatives thereof, any copolymers thereof, and/or any combination thereof. In embodiments comprising one or more organic polymers, the polymer material can comprise one or more appropriate additives such as binders, plasticizers, fillers and the like. Some binders can include epoxides, polyolefins, and any of a wide variety of binders known to one of ordinary skill in the art. Some fillers can include fiberglass, talc and other common fillers as would be apparent to one of ordinary skill in the art. One of ordinary skill in the art will be readily able to select appropriate polymeric materials, fillers, binders, and/or plasticizers based upon properties such as tensile strength, moldability, melting point, glass transition temperatures, cost, and the like.

According to some embodiments the lateral supports of a brick paver support structure can include one or more joists and/or stringer boards. For example, a joist can comprise a 2"×10" board, and a stringer board can have a width that is less than the joist, such as a 2"×4". In such embodiments, the lateral support comprises a joist having a stringer board affixed to at least one face so as to form a ledge. The ledge can support an edge of one or more brick paver shelves. A pair of lateral supports can be arranged so that the stringer boards face each other, thereby forming a seat for supporting one or more brick paver shelves. In some embodiments, one or more medial support boards can be disposed between the lateral supports.

In some embodiments, lateral and/or medial supports can comprise one or more of a wide variety of materials. For example, lateral and/or medial supports can comprise wood, organic polymers, metals, alloys, or any combination thereof. For example, a non-limiting list of organic polymers within the scope of the present invention includes polyolefins such as polypropylene, polyethylene, derivatives thereof, and/or any combination thereof. Other polymers include vinyl polymers, phenolic polymers, polycarbonates, polystyrene, polyesters, polyethylene teraphthalates, nylons, and the like, any derivatives thereof, any copolymers thereof, and/or any combination thereof. In embodiments comprising one or more organic polymers, the polymer material can comprise one or more appropriate additives such as binders, plasticizers, fillers and the like. Some binders can include epoxides, polyolefins, and any of a wide variety of binders known to one of ordinary skill in the art. Some fillers can include fiberglass, talc and other common fillers as would be apparent to one of ordinary skill in the art. One of ordinary skill in the art will be readily able to select appropriate polymeric materials, fillers, binders, and/or plasticizers based upon properties such as tensile strength, moldability, melting point, glass transition temperatures, cost, and the like.

According to some embodiments, paver brick support structures can be installed upon any of a variety of substrate surfaces including, without limitation, dirt, concrete, clay, sand and the like. Some embodiments include installation on concrete slabs such as an existing patio or balcony. According to some light-weight embodiments, a fully assembled paved stricture consistent with the present invention is light enough to be installed on a raised substrate such as a balcony. Furthermore, embodiments of the present invention can be especially useful and desirable for use in areas that are sensitive to large masses, or which have weight limits.

Some embodiments can also include one or more anchors for tethering the paver brick support structure to the substrate surface. For example, some suitable anchors can include perforated metal strips, stakes, various types of screws and other devices as will be apparent to one of skill in the art. Finally, some embodiments can include a filler material for filling the gaps between paver bricks. For example, when bricks are installed in an adjacent relation to one another gaps remain, which can be filled with a suitable material. Some suitable materials include concrete, mortar, grout, sand, dirt or any combination thereof.

Referring now to the drawings wherein the showings are for purposes of illustrating embodiments of the invention only and not for purposes of limiting the same, FIG. 1 is a perspective view drawing of a rectangular brick paver shelf 100 having internal support walls 110 arranged to form hexagonal through holes 120. The internal support walls 110 connect to one another to form internal vertices 130 and peripheral vertices 140. The peripheral vertices 140 connect the two dimensional array of hexagons to an external support wall 150, which defines a rectangular perimeter and completely encloses the perimeter of the array.

Figure 2:
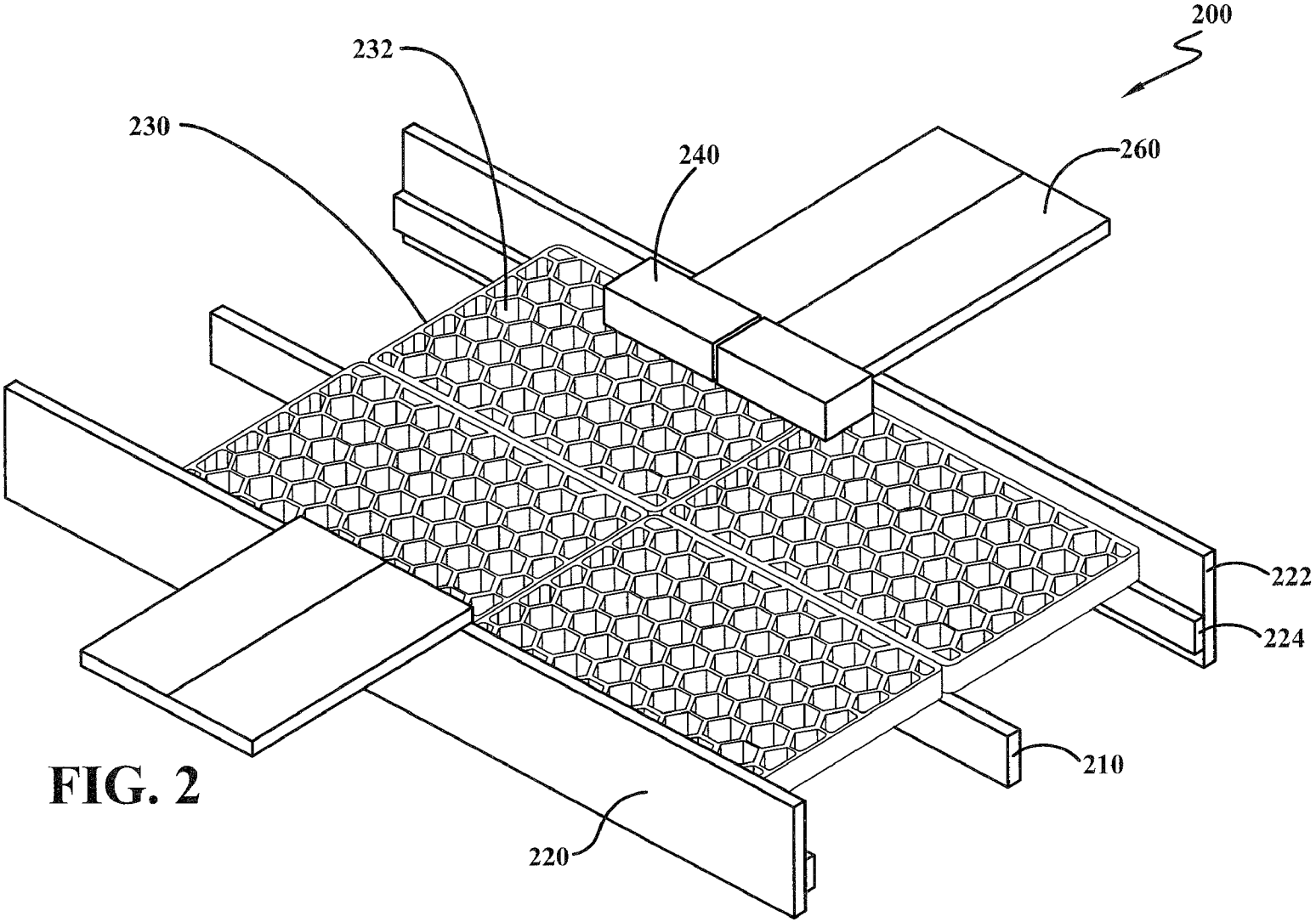
FIG. 2 is a perspective view illustrating a method of installing the support member shown in FIG. 1.

FIG. 2 is a perspective view drawing of a brick paver support structure 200. According to FIG. 2, the support structure 200 comprises two adjacent rows of brick paver shelves 230 supported by a pair of lateral supports 220 and a medial support 210. The lateral supports 220 each comprise a joist 222 and a stringer board 224. As shown in FIG. 2, each row of shelves 230 is supported on one side by a lateral support 220, and on the other side the rows share a medial support 210. Together the lateral supports 220 and medial support 210 form a seat upon which the shelves 230 rest. Brick pavers 240 can be arranged on the shelves 230 so as to form a paved area such as deck, patio, walkway, balcony or the like. The space under the shelves 230 can be occupied by sand and/or gravel. Also shown in FIG. 2, floor boards 260 can be supported by one or more edges of the lateral supports 220. Thus, a wooden structure can abut and/or transition into, a brick-paved area.

Further according to FIG. 2, water can fall on the paved area and drain away from the pavement by passing through the openings 232 in the shelves 230. Thus, rain water can be carried away from the pavement, such as through a French drain or other appropriate drainage means as will be apparent to one skilled in the art. Accordingly, the embodiment shown in FIG. 2 can prevent erosion of the subsurface and prolong the lifespan of the pavement.

Figure 3B:
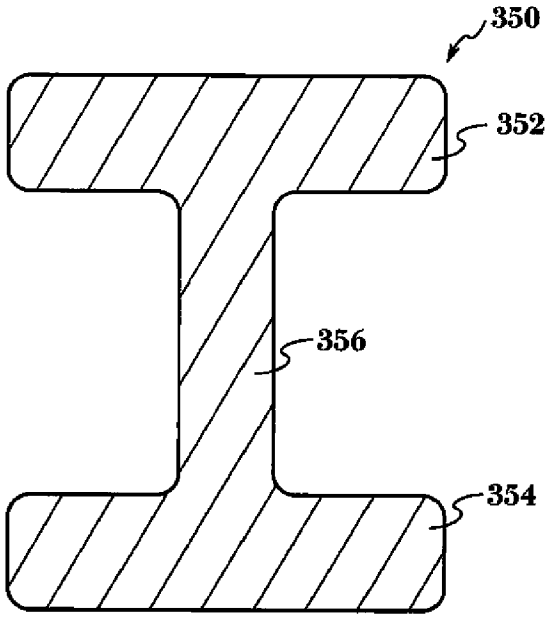
FIG. 3B is a close-up view of a male locking component.
Figure 3A:
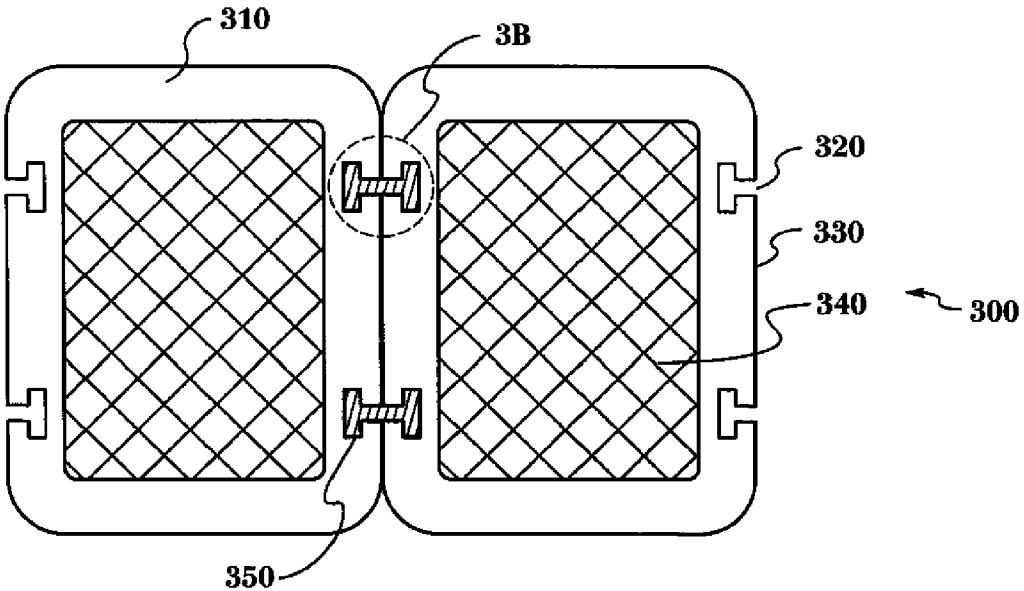
FIG. 3A is a perspective view drawing of an interlocking embodiment comprising male and female locking components.

FIG. 3A is a drawing of an embodiment 300 comprising a pair of adjacent paver brick shelves 330 having female locking components 320 disposed in their external support walls 310, wherein the adjacent shelves 330 are joined together with two doubled ended male locking components 350. FIG. 3B shows the male locking component 350 in more detail. Particularly, the male locking component 350 has a first male end 352 and a second male end 354, and the ends are joined together by a stem portion 356. Accordingly, in this embodiment, the male locking component 350 is in the form of a capital "I" shape.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

Having thus described the invention, it is now claimed:

1. A brick paver shelf, comprising:

a plurality of internal support walls arranged to form a regular two-dimensional network pattern of walls, internal vertices, and peripheral vertices, and the pattern having a top face and a bottom face spaced apart from the top face and defining a thickness sufficient to support a plurality of brick pavers;

at least one external support wall connected to the perimeter of the regular two-dimensional pattern at one or more peripheral vertices of the pattern, the at least one external support wall being adapted to seat upon a support structure in a horizontal orientation, wherein the top face is directed in an upward direction; and a first locking component disposed in the at least one external support wall, wherein the locking component is mateable with a second locking component.

2. The shelf of claim 1, wherein the shelf comprises one or more materials selected from the group consisting of organic polymer, fiberglass, carbon fiber, and graphite.

3. The shelf of claim 2, wherein the organic polymer is selected from one or more of the group consisting of polyethylene, polypropylene, polycarbonates, polystyrene, polyethylene teraphthalates, polyphenol, nylon polymer, and polymer composites of fiberglass.

4. The shelf of claim 1, wherein the internal support walls are arranged to define a regular two-dimensional pattern of shapes selected from the group consisting of circles, triangles, rectangles, pentagons, hexagons, heptagons, octagons and any combination thereof.

5. The shelf of claim 4 wherein the internal support walls are arranged to define a regular two-dimensional pattern of hexagons.

6. The shelf of claim 1, wherein the at least one external support wall encloses the perimeter of the regular two-dimensional pattern of internal support walls and comprises a shape selected from the group consisting of circles, triangles, rectangles, pentagons, hexagons, heptagons, octagons and any combination thereof.

7. The shelf of claim 6, wherein the at least one external support wall encloses the perimeter of the regular two-dimensional pattern of internal support walls and comprises a rectangle.

8. The shelf of claim 7, wherein the rectangle comprises sides ranging in length from about 10 inches to about 48 inches.

9. The shelf of claim 8, wherein the rectangle comprises a first pair of parallel sides ranging in length from about 10 to 36 inches, and a second pair of parallel sides ranging in length from about 10 to 36 inches.

10. The shelf of claim 1, wherein the thickness ranges from about 0.25 inches to about 10 inches.

11. The shelf of claim 1, wherein the first locking component comprises a female locking component and the second locking component comprises a male locking component.

12. The shelf of claim 1, wherein the male locking component is a part separate from the shelf, and wherein the male locking component comprises two male ends that are each simultaneously mateable with adjacent shelves, and adapted to bring the adjacent shelves into a locking relation.

* * * * *